United States Patent [19]

Jackson

[11] 4,428,301

[45] Jan. 31, 1984

[54] RADIAL AXLE RAILWAY TRUCK

[75] Inventor: Keith L. Jackson, Granite City, Ill.

[73] Assignee: Lukens General Industries, Inc., Coatesville, Pa.

[21] Appl. No.: 289,471

[22] Filed: Aug. 3, 1981

[51] Int. Cl.[3] ..... B61F 5/30; B61F 5/38; B61H 5/00; B61H 13/26

[52] U.S. Cl. ..... 105/168; 105/182 R; 105/199 R; 105/224.1; 105/202; 188/59; 188/164; 188/207

[58] Field of Search ..... 105/167, 165, 168, 176, 105/182 R, 82, 194, 195, 197 A, 202, 208, 208.1, 208.2, 224.1, 199 R; 188/59, 72.9, 163, 164, 207, 58; 267/3, 4

[56] References Cited

U.S. PATENT DOCUMENTS

| | | | |
|---|---|---|---|
| 1,661,622 | 3/1928 | Pieper | 188/163 |
| 1,711,602 | 5/1929 | Kindler | 188/59 |
| 2,406,048 | 8/1946 | Tack | 188/59 |
| 2,816,629 | 12/1957 | Bachman et al. | 188/59 |
| 3,538,856 | 11/1970 | Lich | 105/202 |
| 3,650,219 | 3/1972 | Seely | 105/182 R |
| 4,067,262 | 1/1978 | Scheffel | 105/168 |
| 4,111,131 | 9/1978 | Bullock | 105/167 |
| 4,237,791 | 12/1980 | Jackson et al. | 105/168 |
| 4,258,629 | 3/1981 | Jackson et al. | 105/167 |

*Primary Examiner*—Robert B. Reeves
*Assistant Examiner*—Richard Mathieu
*Attorney, Agent, or Firm*—F. Travers Burgess

[57] ABSTRACT

A radial axle railway truck has a pair of depressed center side frames supported at their ends from the axles by horizontal elastomeric pad devices carried on the sides of outboard journal bearing adapters to permit steering movements of the axles, the horizontal pad devices nearest the ends of the side frames being elongated transversely of the truck and the horizontal pad devices remote from the ends of the sideframes being elongated longitudinally of the truck. A transverse truck frame is supported at each side above the depressed center portion of the respective side frames by a pair of generally V-shaped elastomeric pad devices supported on the inclined portions of the side frames connecting the high end portions and the depressed center portions thereof. Both journal bearings on each of the respective axles are connected by a yoke member extending toward the center of the truck and both yoke members are in turn connected by diagonal links to provide equal and opposite turning movements of the axles responsive to yaw and steering movements of the axles. Each axle mounts at least one brake disc and the mechanism therefor is supported from the respective axles and includes shoes underlying the respective axles, each mechanism being connected to the truck frame to transmit braking torque thereinto in a longitudinal direction only and thus oppose inertial longitudinal movement of the truck frame with respect to the axles during retardation of the axles, without interfering with steering movements of the respective axles.

30 Claims, 14 Drawing Figures

RADIAL AXLE RAILWAY TRUCK

BACKGROUND OF THE INVENTION

1. Field of the Invention

The invention relates to railway rolling stock and consists particularly in radial axle trucks of the outside bearing separate-sideframe type having disc brake systems offering minimal interference to self-induced steering movements of the respective axle.

2. The Prior Art

In recent radial axle trucks of the separate sideframe type, as exemplified by Herbert Scheffel U.S. Pat. Nos. 4,067,261, 4,067,262 and 4,136,620; Robert L. Bullock U.S. Pat. No. 4,111,131 and Harold A. List U.S. Pat. No. 4,131,069, the truck framing consists of a transverse bolster supported by upright coil springs on the side frames and slidably mounted between column guides on the respective side frames to maintain the side frames and bolster in squared relation. In Frederick W. Sinclair U.S. Pat. No. 2,981,208, a transverse frame member is mounted on a pair of side frames each rigidly mounted on journal boxes, by V-shaped elastomeric spring devices inclined slightly longitudinally of the truck and a body-supporting bolster is spring-supported on the transverse frame, the axles being held in parallel relation with each other by the rigid connection of the journal boxes to the respective side frames. In the Scheffel patents noted above, the journal boxes of the respective axles are connected to each other by a yoke-like device and the yoke-like devices of the respective axles are connected to each other by diagonal links. In certain of the above-mentioned Scheffel patents and the Bullock patent, the axle box adapters supporting the side frames by a pair of fore and aft rubber pad devices are positioned below and above the respective journal box. None of the prior art patents discloses the use of disc brakes on the axles with the brake shoes positioned below the respective axle and connected to the transverse frame in such a way that any longitudinal movement of the axle centers with respect to the truck frame is opposed during braking.

SUMMARY OF THE INVENTION

An object of the invention is the provision of a radial axle railway truck having resilient means supporting separate side frames on the journal bearings to accommodate relative yaw and steering movements of the respective axles while opposing forces tending to tilt the side frames transversely of the truck, and means resiliently supporting a main transverse frame on the side frames arranged to stabilize the main frame against tilting longitudinally of the truck while permitting the side frames to tilt longitudinally with respect to the main frame and each other to conform to differential vertical irregularities in the track rails, and permitting the main frame to move vertically with respect to the side frames to cushion the main frame against vertical shocks received from the track structure. This objective is achieved by the use of side frames having end portions positioned above the journal bearings, depressed center portions and sloping portions connecting the end and center portions and supporting the main frame on the side frames by chevron-shaped elastomeric pad devices supported over the sloping portions of the side frames and inclined oppositely longitudinally of the truck with their central normals intersecting the vertical planes of the respective axle axes at a lower level than the neutral axes of the side frames.

A further object of the invention is to provide a disc brake arrangement for radial axle railway trucks in which the brake mechanism is maintained in symmetrical relation with the axle mounted discs irrespective of the tangent-track or curved track position of the axles and the braking torque is taken into the truck frame in a horizontal longitudinal direction opposite to the direction of movement of the truck along the track so as to oppose forward inertial movement of the truck frame relative to the axles during brake applications and thereby maintain the normal longitudinal relationship of axles and frame under braking conditions. This object is achieved by supporting the disc brake mechanism associated with each disc, without restraint longitudinally of the truck, from a yoke mounted on the journal bearing adapters with the brake shoes positioned directly beneath the axles and the levers extending longitudinally horizontally therefrom, and connecting the respective mechanism to the truck frame by means of a longitudinally extending substantially horizontal link.

A further object is to stabilize the journal bearing adapters, yokes and elements supported by the yokes against tilting horizontally of the truck about the axle while supporting the side frames on the respective journal bearing adapters by horizontal elastomeric pad devices on opposite sides of the boxes positioned at different levels to conform to the slope of the side frame sloping portions by positioning the pad devices carried by each adapter so that the line connecting their centers passes substantially through the respective journal center.

DETAILED DESCRIPTION OF THE INVENTION

Figure 1:
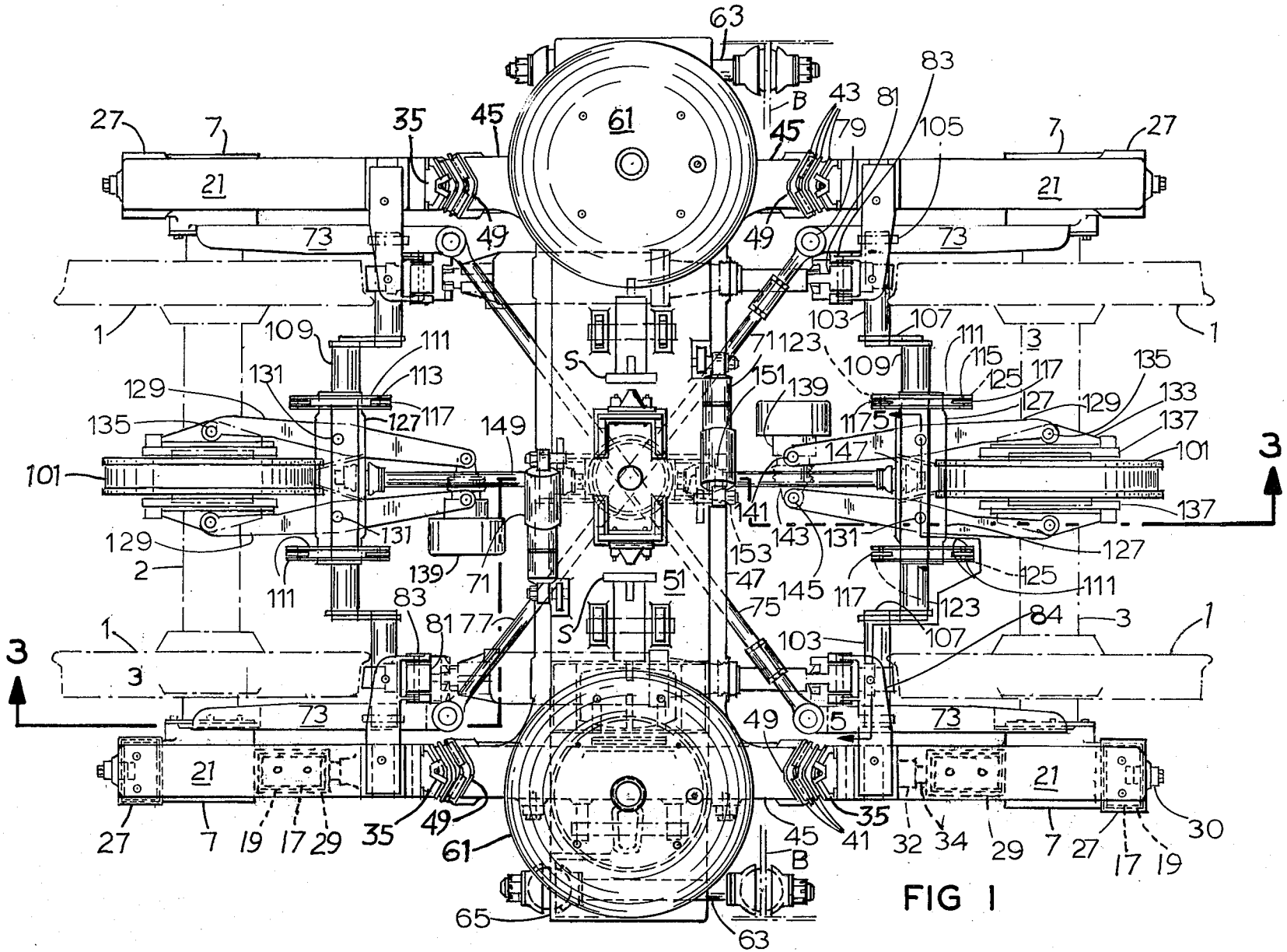
FIG. 1 is a plan view of a truck embodying the preferred form of the invention.

Referring first to FIGS. 1-5, the numeral 1 denotes railway flanged wheels mounted in gauged pairs respectively on railway axles 2 and 3. Preferably the treads of wheels 1 are profiled and are of sufficient effective conicity to effect self-steering of the respective axles 2 and 3 from positions transverse of the track on tangent track to positions radial of the track on curved track. The outboard ends, or journal portions, of axles 2 and 3 are rotatably received in bearings 5 mounted in adapters 7, each formed with a pair of fore and aft wings 9 and 11, wings 9 having an upwardly facing horizontal surface 13 positioned substantially higher than the center of the bearing and wings 11 having a corresponding upwardly facing horizontal surface 15 positioned substantially lower than the bearing center. Each wing surface 13 and 15 mounts elastomeric pad devices consisting of flat horizontal elastomeric pads 17 bonded and interleaved by metal plates 19.

Longitudinally extending side frames, preferably of cast steel and of box section, have end portions 21 overlying bearings 5, straight depressed center portions 23 at a lower level than the centers of bearings 5 and sloping portions 25 connecting end portions 21 and depressed center portions 23. The end portions 21 are formed at their extremities with downwardly facing surfaces 27 resting on the pad devices on bearing adapter wings 9, and the sloping portions 25 of the side frames have similar downwardly facing surfaces 29 resting on the pad devices 17, 19 carried by the lower wings 11 of bearing adapters 7, the line connecting the centers of the pad devices on each bearing adapter passing through the center of the respective bearing, whereby to avoid applying overturning moments tending to rotate the adapters about the respective axles.

For preventing vertical separation of side frames 21, 23, 25 from bearing adapters 7, each end of each side frame detachably mounts a depending J-shaped bar 30, the lower end of which underlies the top wall of the outer wing 9 of the adjacent bearing adapter, and a depending bracket 32 from each side frame sloping portion 25 detachably mounts a horizontal L-shaped bar 34 extending beneath the top wall of the adjacent adapter wing 9.

Figure 2:
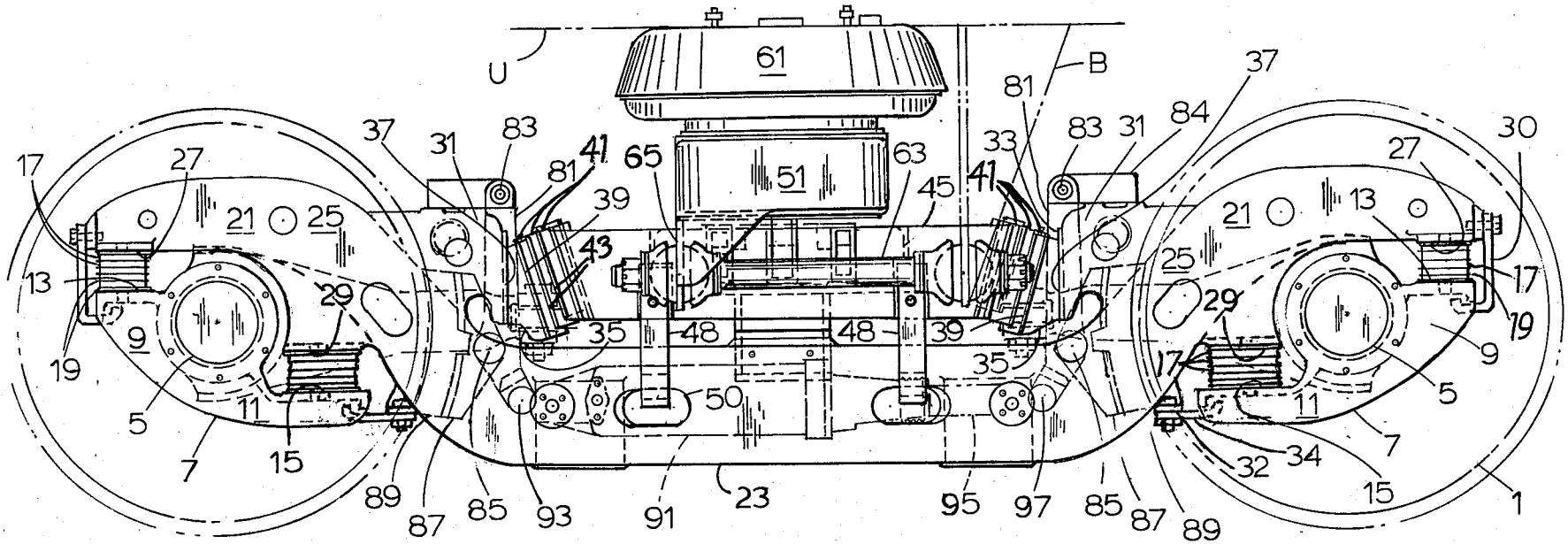
FIG. 2 is a side elevational view of the truck illustrated in FIG. 1.
Figure 3:
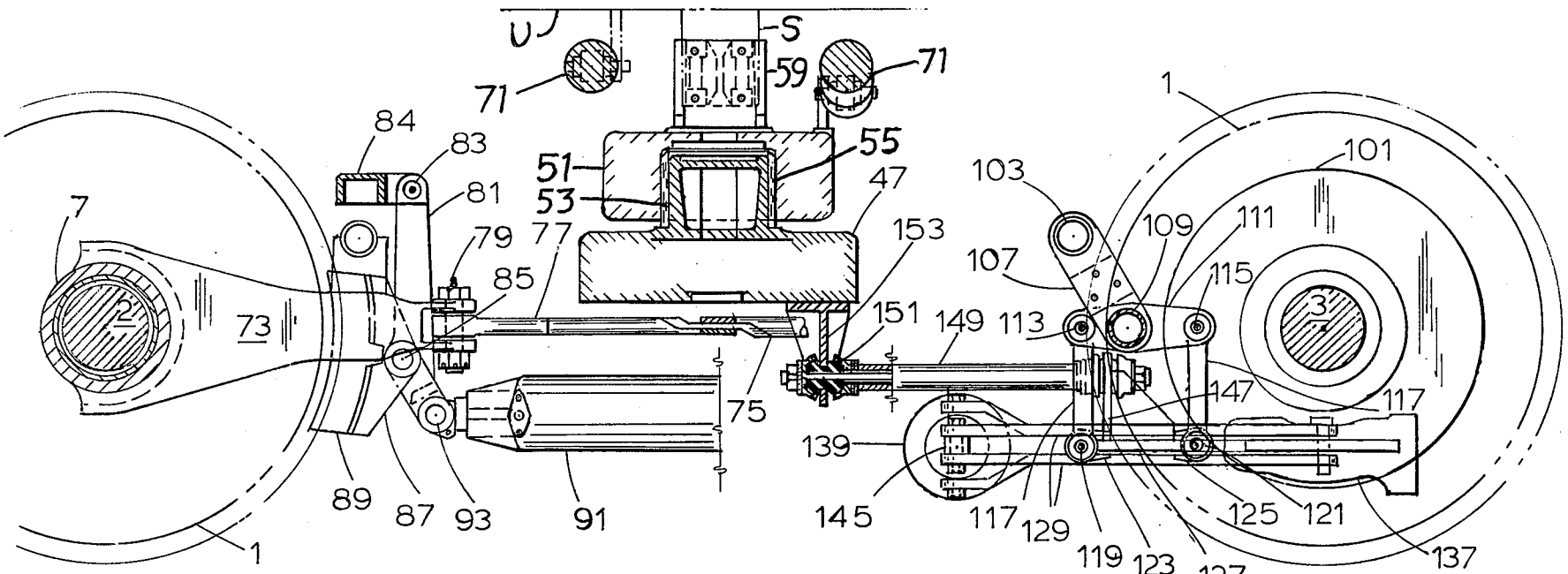
FIG. 3 is a longitudinal vertical sectional view taken along line 3—3 of FIG. 1.
Figure 4:
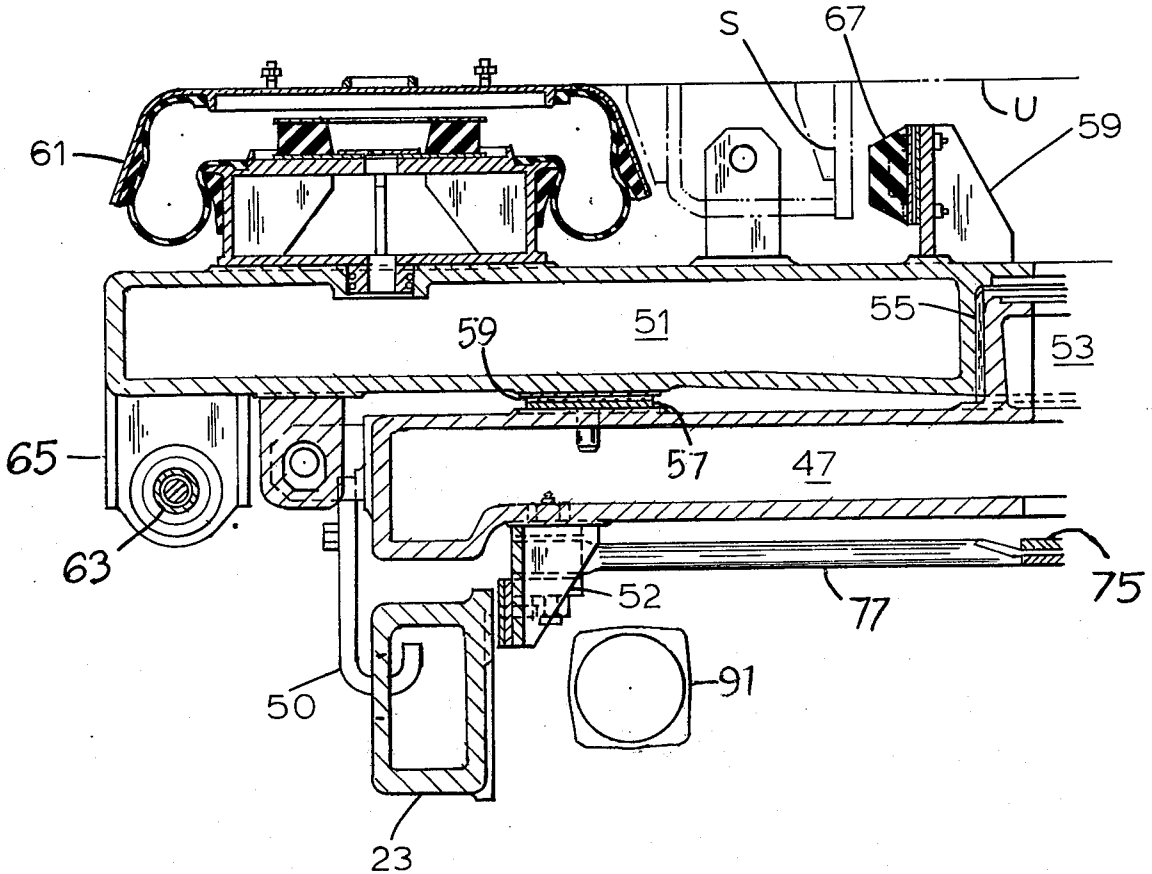
FIG. 4 is a transverse vertical sectional view taken along line 4—4 of FIG. 1.
Figure 5:
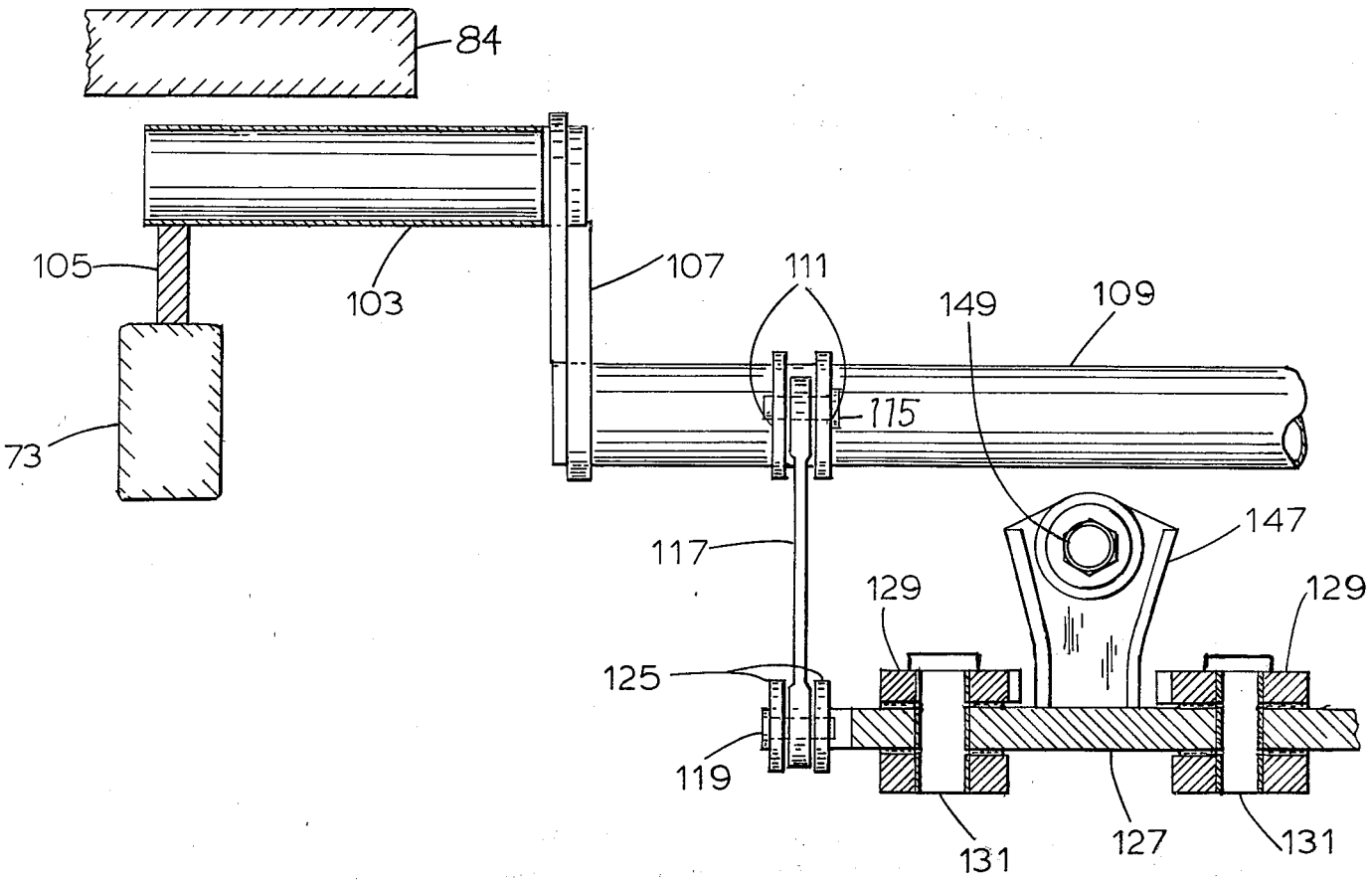
FIG. 5 is a partial transverse vertical sectional view of the truck illustrated in FIGS. 1-4.
Figure 6:
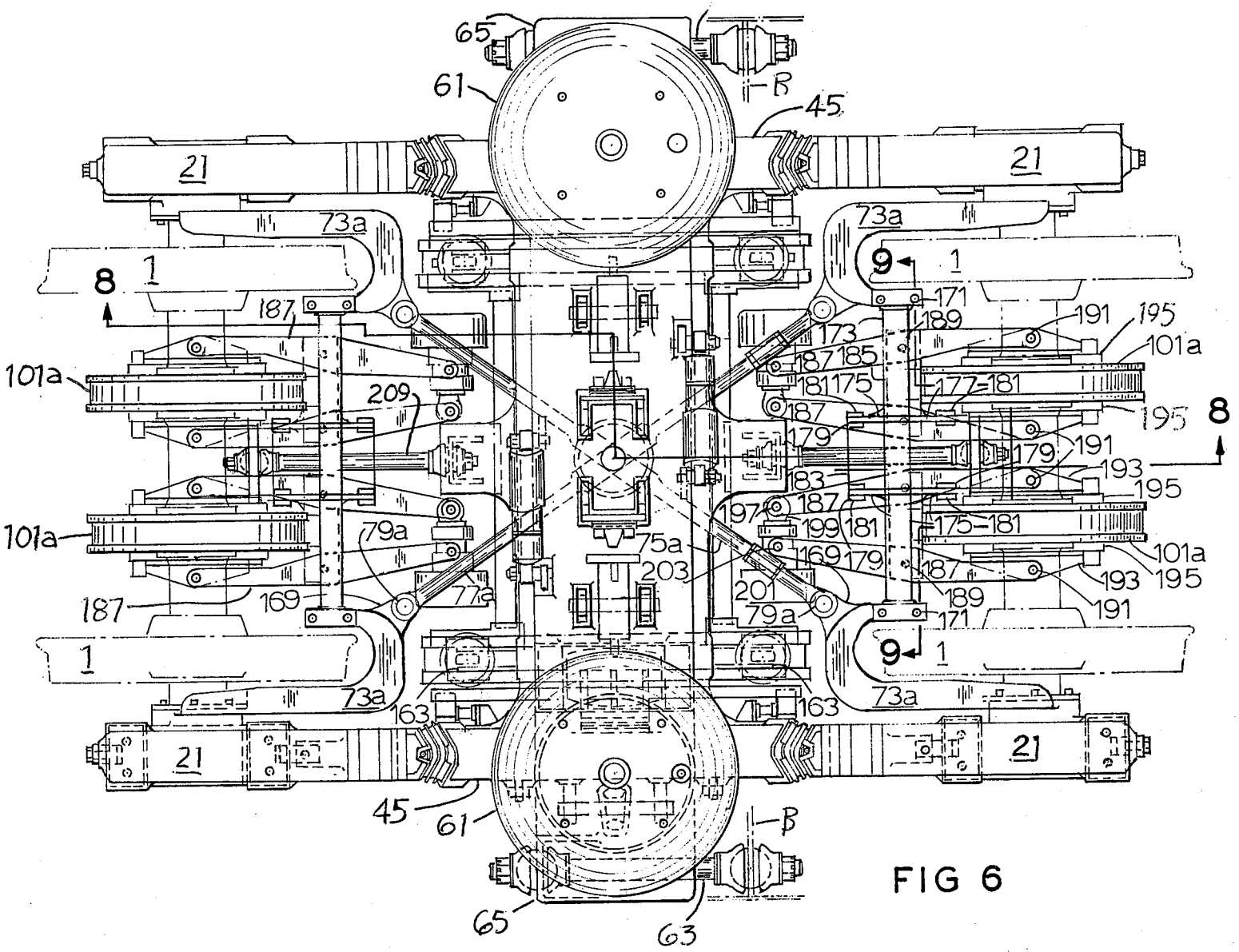
FIG. 6 is a plan view of a truck embodying a modified form of the invention.
Figure 7:
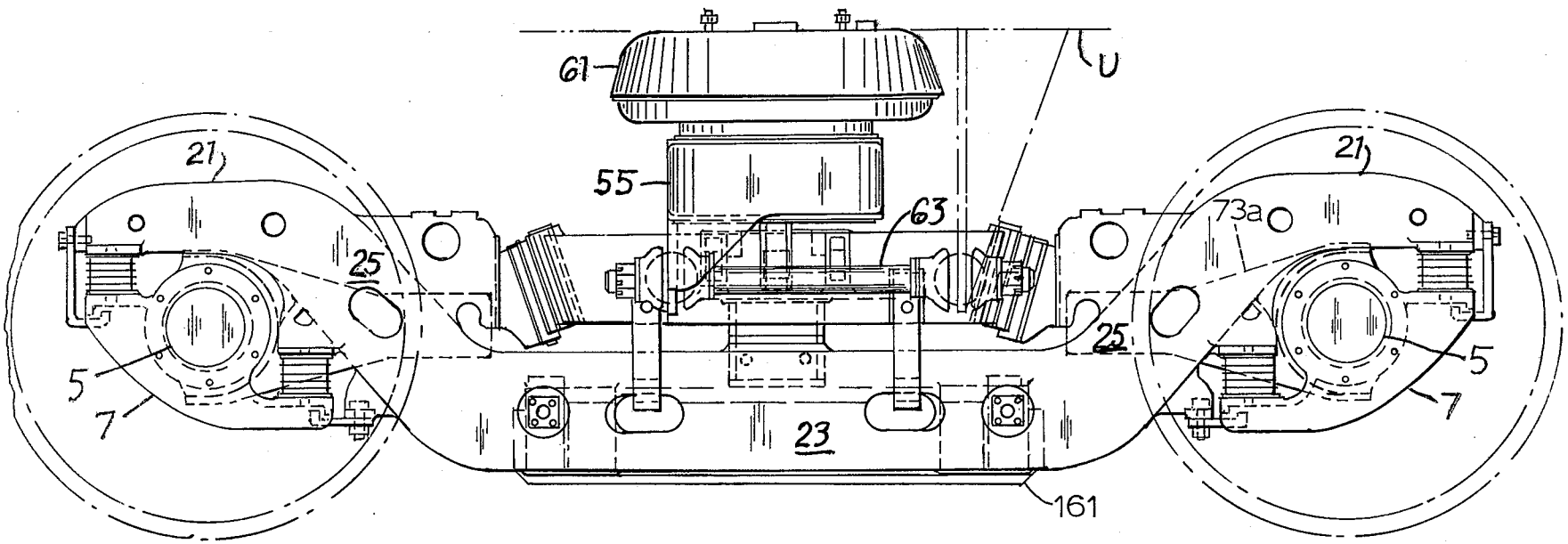
FIG. 7 is a side elevational view of the truck illustrated in FIG. 6.
Figure 8:
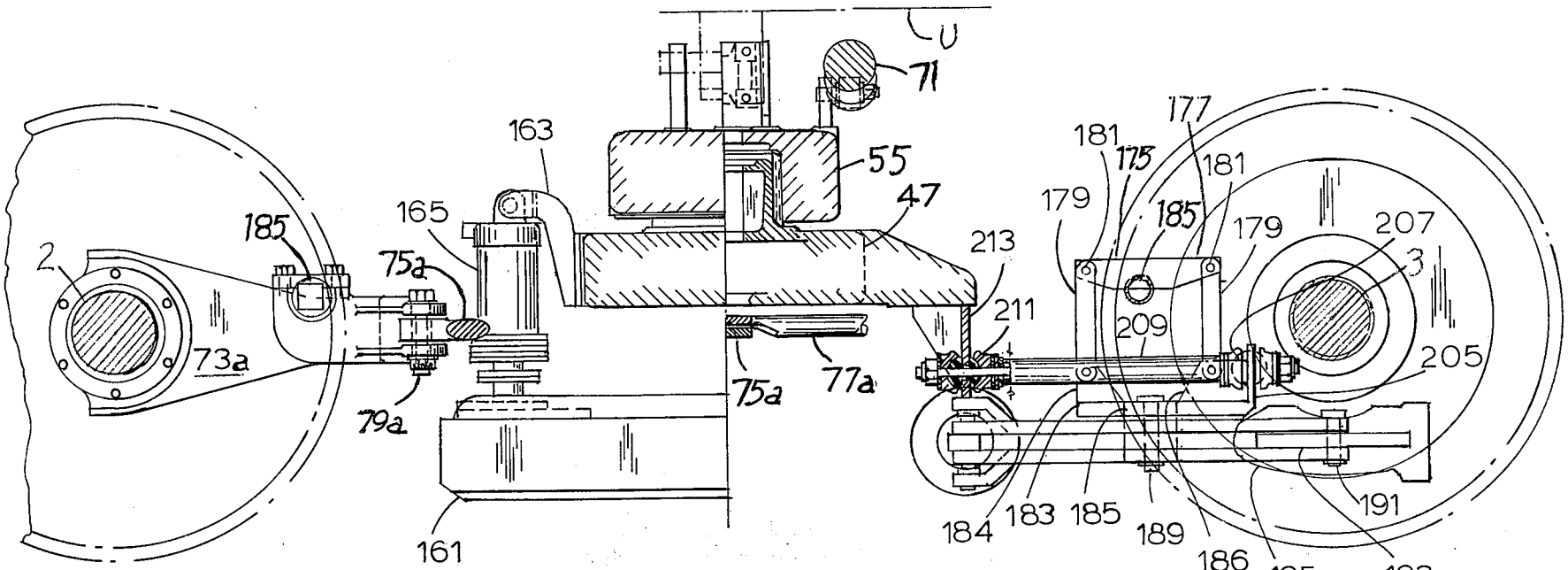
FIG. 8 is a longitudinal vertical sectional view taken along line 8—8 of FIG. 6.
Figure 9:
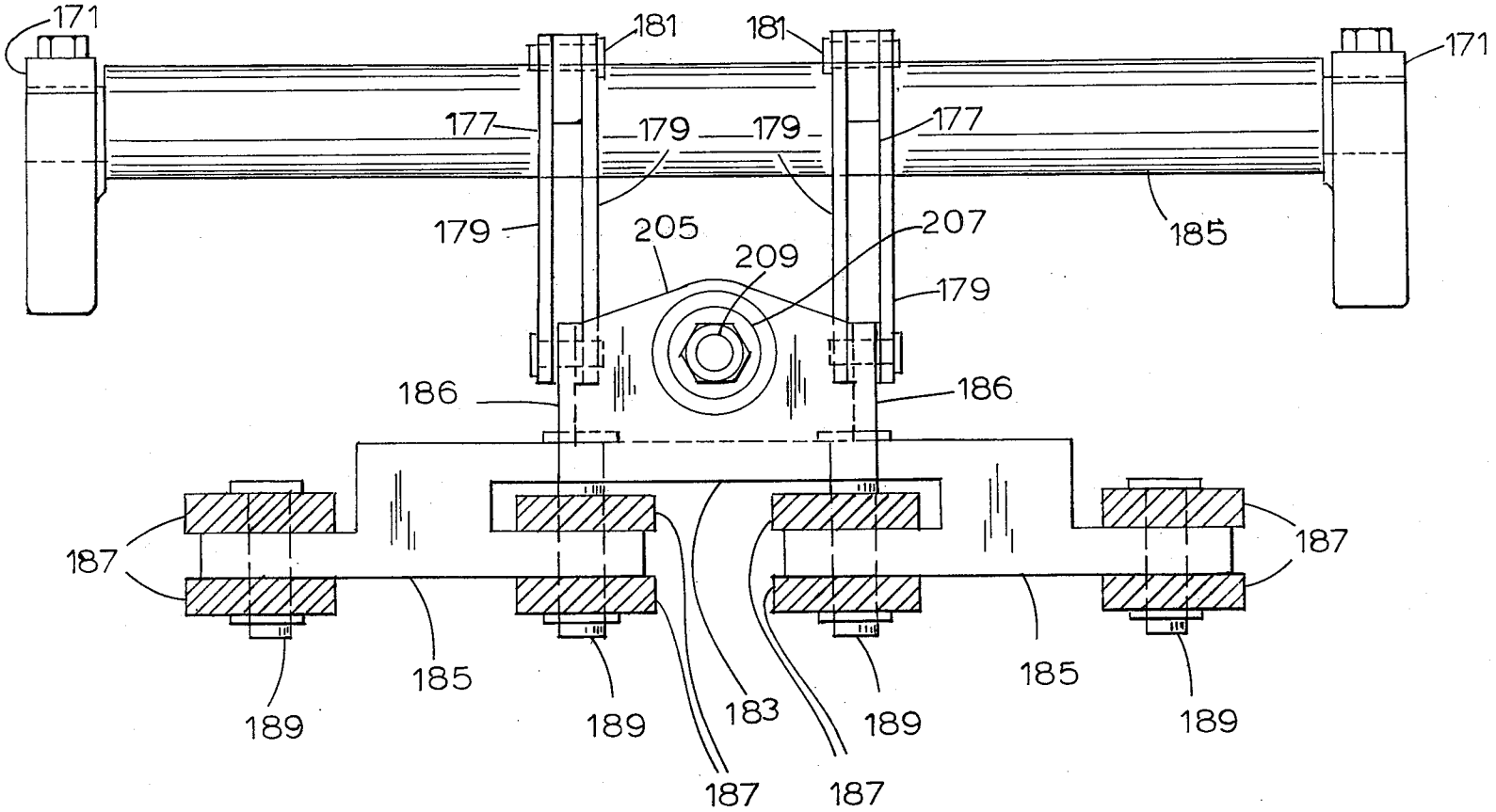
FIG. 9 is a partial transverse vertical sectional view taken along line 9—9 of FIG. 6.
Figure 10:
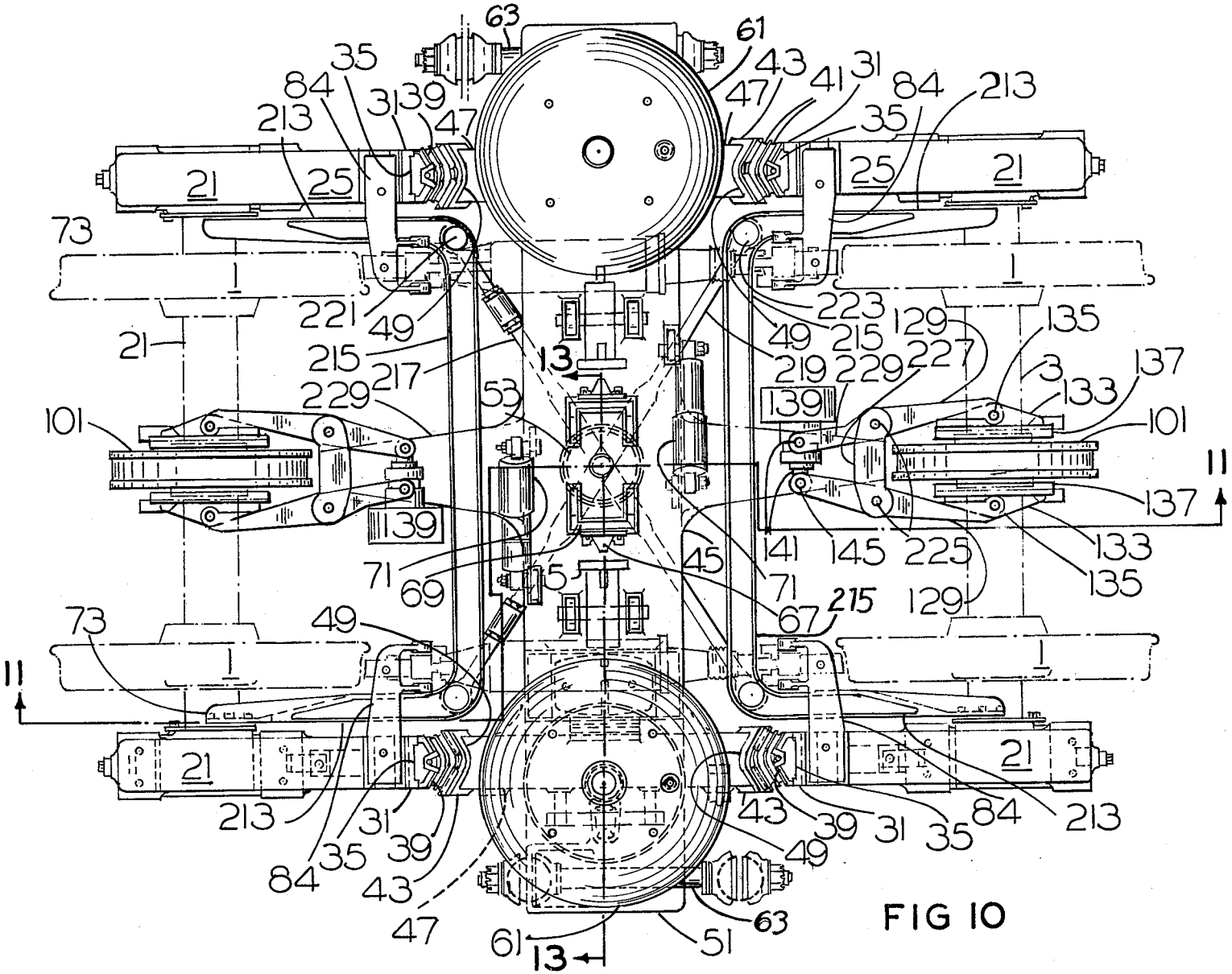
FIG. 10 is a plan view of a truck incorporating a second modification of the invention.
Figure 11:
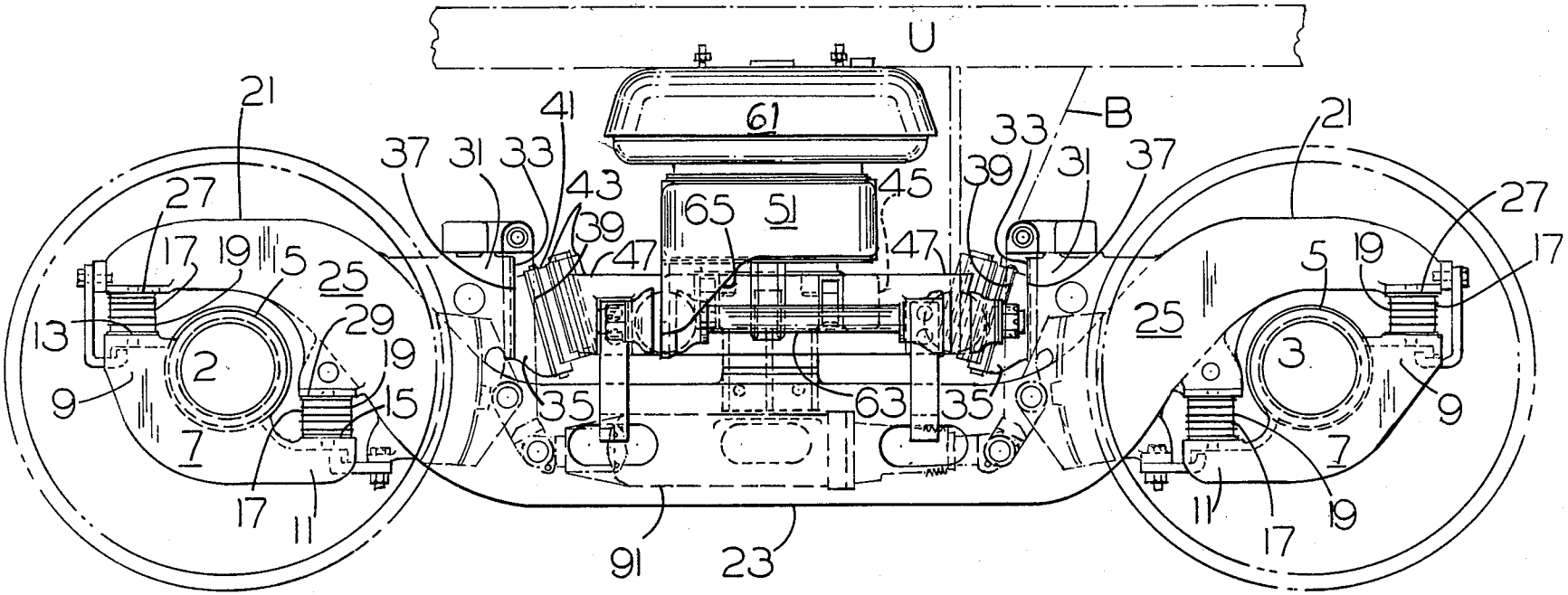
FIG. 11 is a side elevational view of the truck illustrated in FIG. 10.
Figure 12:
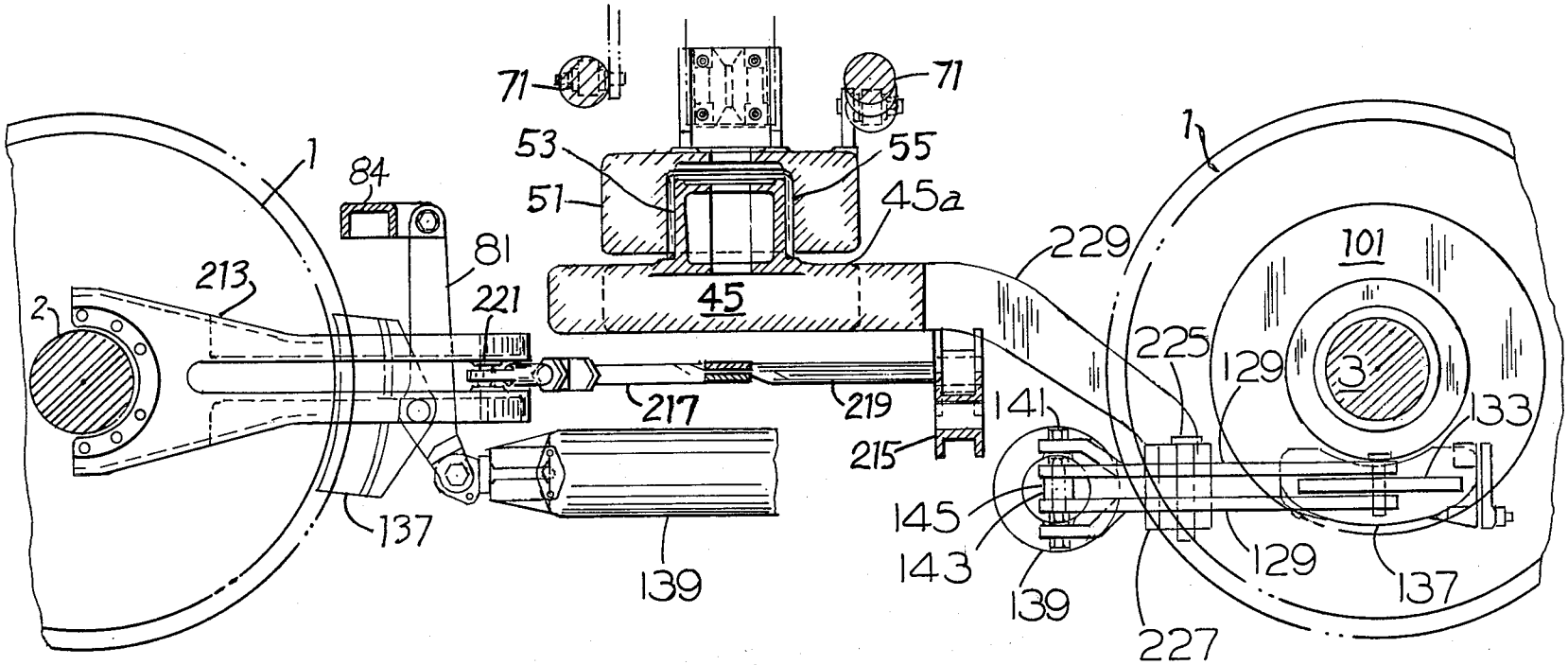
FIG. 12 is a longitudinal vertical sectional view taken along line 11—11 of FIG. 10.
Figure 13:
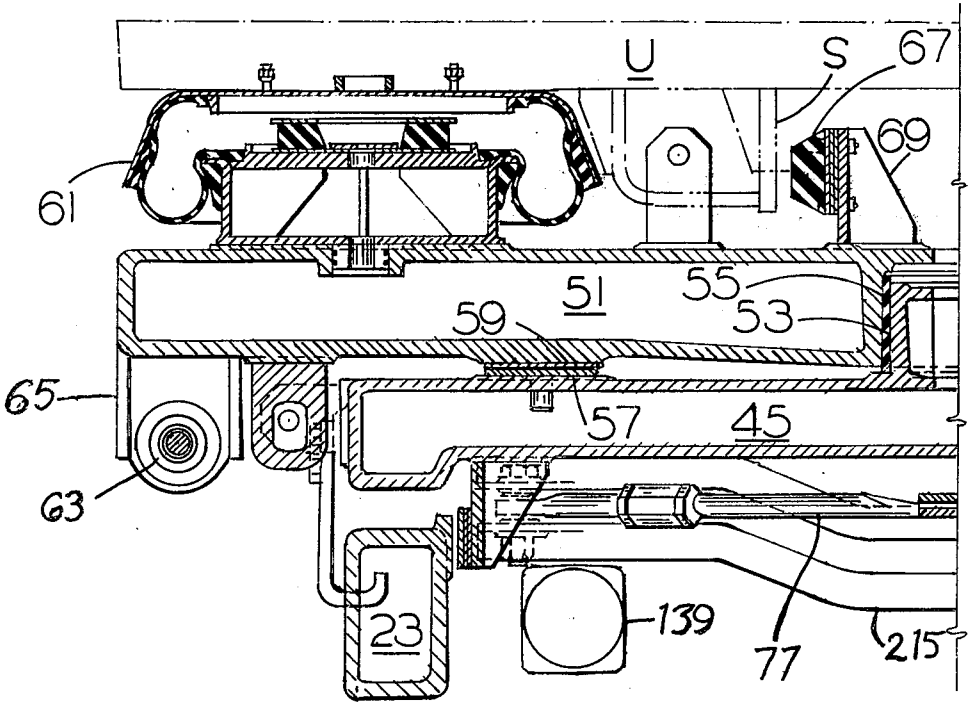
FIG. 13 is a transverse vertical sectional view taken along the line 13—13 of FIG. 10.
Figure 14:
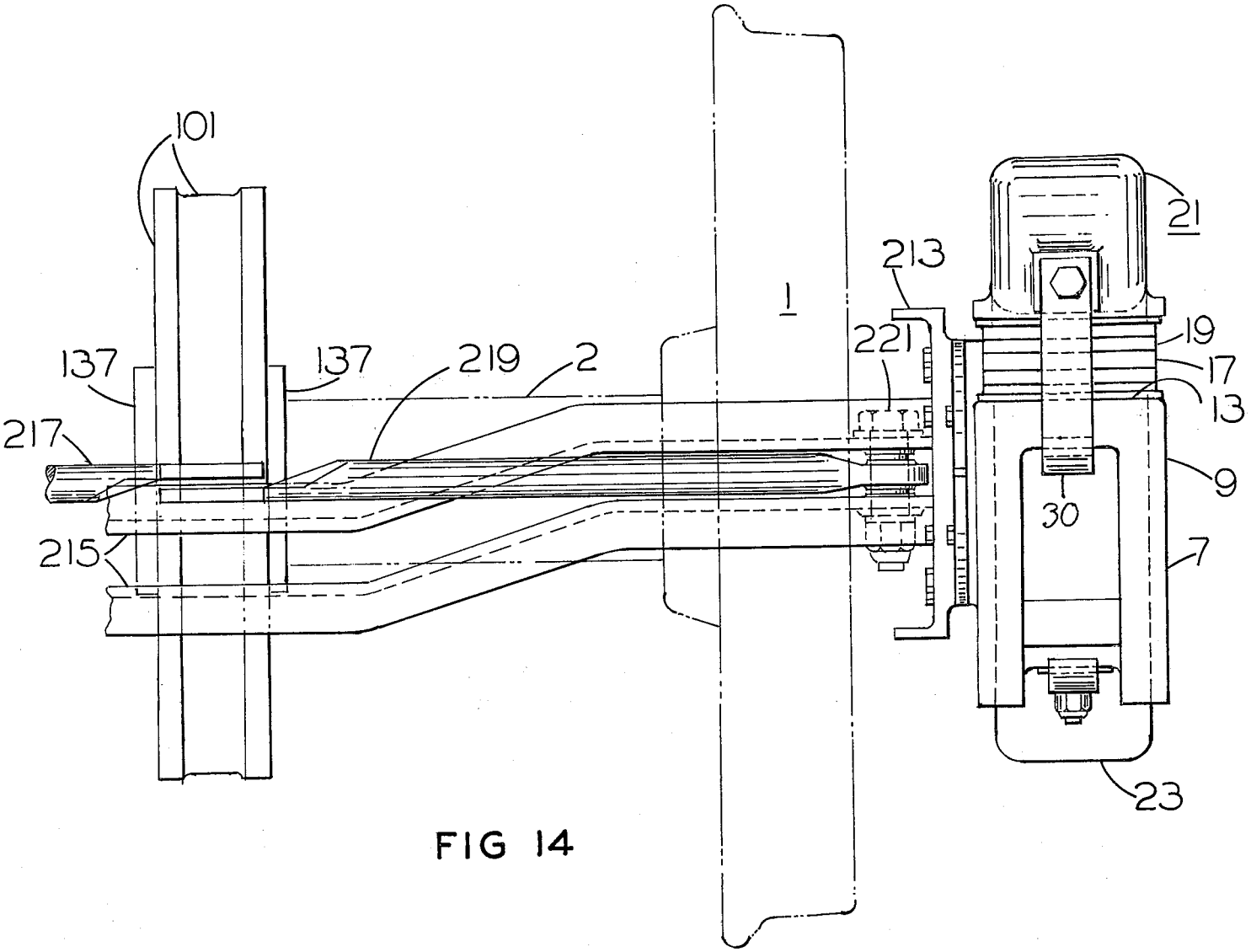
FIG. 14 is an end view of the truck illustrated in FIG. 10.

As best seen in FIGS. 1 and 2, the pad devices 17, 19 near the ends of the side frames and co-operating bearing adapter surfaces 13 and side frame surfaces 27 are elongated in plan with their long dimensions extending transversely of the truck to offer maximum resistance to transverse forces tending to tip the respective side frames transversely, while pad devices 17, 19 remote from the ends of the side frames and co-operating bearing adapter surfaces 15 and side frame surfaces 29 are elongated in plan with their long dimensions extending longitudinally of the truck to provide additional lateral clearance from structure such as adapter arms 73 (described hereinafter).

On the upper faces of the side frame sloping portions 25 are formed upstanding abutments 31 having transverse vertical mounting faces 33 facing each other and spaced apart longitudinally of the side frame. An elastomeric spring device comprising an adapter 35 having a vertical face 37 complementary with abutment vertical face 33 and a sloping face 39 of convex V-shape in plan with its apex pointing longitudinally of the side frame toward the center of the truck, and a correspondingly V-shaped elastomeric pad device comprising elastomeric pads 41 interleaved and bounded by V-shaped metal plates 43 secured to the sloping face 39 of adapter 35 is mounted on the vertical face 33 of each of the side frame abutments 31. A main frame comprising longitudinally extending side members 45 rigidly connected by transom 47 is supported on spring devices 41, 43 by the end portions of side members 45, which are formed with concave generally V-shaped surfaces 49, complementary of and similarly sloping with respect to convex V-shaped surfaces 39 of elastomeric spring adaptors 35.

For preventing separation of side frames 21, 23, 25 from main frame 45, 47, side members 45 detachably mount depending J-shaped bars, the lower ends of which project into apertures 50 in the respective side frame center portion 23.

For limiting transverse movement of the main frame on the side frames, in the event excessive lateral forces are encountered, transom 47 is formed with depending lateral stop brackets 52 inboard of the side frames, the latter being faced with elastomeric pads slightly spaced from and in opposed relation to the inner vertical surfaces of side frame center portions 23 and adapted to engage the latter only in the event excessive lateral forces occur.

With the arrangement disclosed, it will be evident that the bearings 5 and their adapters 7 are capable of limited movement lengthwise of the truck to permit limited yawing and wheel-induced steering movements of the respective axles 2 and 3. The truck frame 45, 47 can move vertically on V-shaped elastomeric pad devices 41 and 43 because of their yieldability in shear, such movements being restricted by their resistance to compression and shear resistance and side frames 21, 23, 25 can tip longitudinally of the truck with respect to frame 45, 47 and each other to accommodate the wheels to differing vertical irregularities in the respective track rails.

For supporting a vehicle body, a transverse bolster 51 is swivelly mounted on frame transom 47 by a swivel bearing comprising an upstanding cylindrical boss 53 at the center of the transom 47 pivotally received within a complementary cylindrical recess 55 in bolster 51, and by opposed slidably engaged side bearing elements 57 and 59 on transom 47 and bolster 51 respectively. At each of its ends, bolster 51 mounts a flexible wall pneumatic spring device 61 on which is seated the vehicle underframe U. For transmitting longitudinal forces between the truck and body underframe U, the latter is provided with a depending bracket B at each side to the lower end of which is secured one end of a longitudinally extending bolster anchor link 63, preferably constructed in accordance with J. C. Travilla U.S. Pat. No. 3,315,555, the other end of which is secured to a bracket 65 depending from the respective end of bolster 51. Pneumatic spring device 61 is capable of horizontal as well as vertical deflection, whereby the car body underframe U is permitted to move vertically and laterally with respect to bolster 51 to cushion vertical and lateral shocks received by the truck from the track structure. To limit lateral movements of the underframe on the bolster, underframe U is formed with depending lateral stop brackets S engageable by elastomeric bumpers 67 mounted on upstanding lteral stop brackets 69 on bolster 51.

For damping lateral movements of the underframe U on the truck permitted by pneumatic spring devices 61, bolster 51 is connected by transversely extending snubbing devices 71 to the underframe.

Preferably the axles are self-steering by virtue of profiled treads on wheels 1 of sufficient conicity to position the axles radially on curved track, the required turning movements in the horizontal plane being accommodated by horizontal shear in pad devices 17, 19.

Each of the adapters 7 rigidly mounts a longitudinally extending arm 73 preferably cast integral with the respective adaptor and extending longitudinally therefrom toward the center of the truck and at their inner ends diagonally opposite arms 73 are connected by diagonal rods 75 and 77 pinned at their ends respectively at 79 to the diagonally opposite adapter arms 73 so that when the axles are steered, the rods 75 and 77 will accommodate their turning movements in the horizontal plane in opposite senses and so that when the wheel and axle assemblies tend to hunt either on tangent or curved track, the oscillatory movements are transmitted by rods 75 and 77 equally in magnitude but opposite in sense from one wheel and axle assembly to the other causing the wheel and axle assemblies to oscillate out of phase with each other and with the side frames to generate stabilizing creep forces in the wheel-rail interface and thereby damp or inhibit hunting. This coupling between the separate wheel and axle assemblies is constructed and operates substantially in accordance with the teachings of Herbert Scheffel, as disclosed in his U.S. Pat. No. 4,067,261.

This truck has a dual braking system consisting of a tread brake arrangement having levers 81 pivotally suspended at 83 from inboard brackets 84 on the respective side frames and pivotally supporting at 85, intermediate their ends, brake heads 87 mounting wheel-engaging brake shoes 89. The lower extremities of levers 81 are connected to each other by a longitudinally extending fluid-actuated cylinder 91, one end of which is pivotally connected at 93 to one of the levers 81 and a piston 95 slidable in cylinder 91 and pivotally connected at its outer end at 97 to the lower end of the other lever 81, the cylinders at opposite sides of the truck being interconnected to each other and connected to a common source of pressurized fluid substantially as described in Keith L. Jackson U.S. Pat. No. 4,134,343, Keith L. Jackson et al U.S. Pat. No. 4,237,791 and Keith L. Jackson et al U.S. Pat. No. 4,238,006. As clearly described in the foregoing patents, the combined length of the piston and cylinder assemblies at each side will conform to the longitudinal spacing of the wheels at the respective sides because of the fluid interconnection between the two cylinders so that irrespective of whether the axles are in their tangent track parallel positions or their curved track radial positions, the brake pressure is equalized on all four wheels without affecting the relative positions of the axles.

A disc brake system, operable in parallel with the tread brake arrangement just described includes a single brake disc 101 mounted at the center of each of the axles. To avoid resistance by the disc brake arrangement to self-induced steering movements of the respective axles, the adapter arms 73 on each axle are connected by a composite transverse member comprising inwardly extending short tube sections 103 anti-rotatably secured to upstanding plates 105 on the respective adapter arms 73 and mounting at their inner ends offset plates 107 which are inclined longitudinally of the truck generally toward the respective axle and mount at their lower ends brake mechanism support tube 109 in the closest proximity to the axle consistent with clearing brake disc 101. It will be seen from the foregoing that the transverse member 103, 107, 109, in view of its mounting on the adapter arms 73 forms a rigid yoke, constantly in fixed relation with the respective axles 2 and 3 so that any brake mechanism supported therefrom will similarly be in fixed relation to the respective axle. On both sides of the disc 101, tube 109 fixedly mounts a pair of fore and aft longitudinally extending arms 111 from the ends of which, at 113 and 115, are pivotally suspended substantially identical vertical links 117, pairs of which are spaced apart both transversely and longitudinally of the truck. At their lower ends links 117 are pivotally connected at 119 and 121 to fore and aft clevis brackets 123, 125 on brake lever fulcrum support member 127. A pair of double longitudinally extending brake levers 129, 129 are fulcrumed at 131, 131, spaced apart transversely of plate 127 and mount at one end brake heads 133 positioned directly below the respective axle 2 or 3 on opposite sides of disc 101, brake heads 133 being pivotally connected at 135 to the ends of the respective levers 129 and mounting friction shoes 137 for selective gripping engagement with the opposite faces of the respective disc 101. For actuating the respective brake levers 129, a fluid pressure cylinder 139 is pivotally connected at 141 to one of the levers and its piston rod 143 is pivotally connected at 145 to the other lever so that upon the introduction of pressurized fluid into cylinder 139, the adjacent ends of the brake levers will be spread apart, causing the opposite ends to force friction shoes 137 into gripping engagement with disc 101.

For resisting braking torque reactions, brake lever fulcrum plate 127 is provided with an upstanding flange 147, which mounts via a spherical connection a longitudinally extending link 149 preferably constructed in accordance with J. C. Travilla U.S. Pat. No. 3,315,555, the other end of which is similarly secured at 151 to a bracket 153 depending from truck frame member 45.

From the foregoing, it will be seen that irrespective of the angular position of the axle in the horizontal plane (whether transverse of the truck frame as on tangent track or angled as on curved track) the brake mechanism, including shoes 137 and levers 129 will be symmetrically positioned with respect to disc 101 so that when, for braking purposes, pressurized fluid is introduced into cylinder 139 causing shoes 137 to grippingly engage disc 101, the braking torque will be taken longitudinally via levers 129 and fulcrum pins 131 into fulcrum plate 127 which is held against any other than horizontal movement longitudinally of the truck by parallel links 117 and thence through flange 147 into and longitudinally through link 149 and bracket 153 into truck frame transom 47, parallel links 117 nullifying the effect of any eccentric moment which would arise from the vertical offset of link 149 from brake levers 129. The spherical connections of link 149 to frame bracket 153 and brake lever fulcrum plate flange 147 accommodate relative vertical lateral and steering movements of the axles relative to the truck frame while at all times taking braking torque in a direction longitudinally of the truck and thus resisting any tendencies of the truck frame to continue forward longitudinal movement due to inertia with respect to the wheel and axle assemblies during brake applications. This results because, with the underslung location of brake shoes 137, braking torque is directed rearwardly through levers 129 and link 149, such that the link 149 associated with the front axle brake pushes on frame transom 47 and the link 149 associated with the rear axle brake pulls on frame transom to oppose continued forward inertial movement of the latter.

In the embodiment of the invention illustrated in FIGS. 6–9, the truck also has a dual braking system consisting of an electromagnetic track brake magnet 161 suspended from brackets 163 on the transom 47 by brake operating cylinders 165, brackets 163 lying in the general plane of the wheels at each side and extending from the transom towards the wheels so as to support the brake magnet 161 above and in alignment with the track rails.

In order to avoid interference between axle adapter arms 73*a* and track brake support brackets 163 and track brake cylinders 165, arms 73*a* are of J-shape in plan with their inner terminals 167 curved around the respective wheels longitudinally inboard of the axles, and the diagonal rods 75*a* are pinned at 79*a* to inwardly extending clevis brackets 169 on the inwardly bent terminal portions 167 of arms 73*a* such that the axial projections of diagonal rods 75*a* and 77*a* pass through the centers of the journals. The inner terminals 171 of arms 73*a* inboard of the respective wheels anti-rotatably mount a brake disc mechanism support tube 173 extending transversely of the truck, i.e., parallel to the axle. A pair of brake discs 101*a*, 101*a* are secured to the axle in spaced relation with each other equidistant from the center of the axle and symmetrically spaced from the adjacent wheels. Brake mechanism support tube 173 has longitudinally extending brackets 175 and 177 extending respectively in opposite directions longitudinally from the tube in alignment with each other and spaced apart transversely of the tube equidistant from the truck center and more closely than the transverse space between the adjacent discs, and identical swing links 179 are pivoted at 181 to depend vertically therefrom to support the central longitudinally elongated portion 183 of cruciform brake lever fulcrum support plate having transverse arms 185 by pivotal connection to upstanding brackets 184 and 186 on central portion 183 of the fulcrum support plate. Pairs of generally longitudinally extending double brake levers 187 are fulcrumed at 189, 189, 189, 189 on fulcrum plate 183, 185, the fulcrums 189 and the respective pairs of levers being substantially symmetrically located transversely of the truck with respect to the respective discs 101*a*, 101*a* and the double levers 187 are positioned substantially below the axle and mount directly below the axle via pivots 191, 191, 191, 191 pairs of brake heads 193, 193, 193, 193 positioned directly below the axle and at opposite sides of the respective discs 101*a*, 101*a*, brake heads 193 mounting a friction shoe 195 adapted for frictional gripping engagement with the respective discs 101*a*, 101*a* for actuating the levers 187, 187 associated with each disc to move the respective shoes into frictional engagement with the disc, the remote end of one of the inside levers associated with each disc is pinned at 197 to the piston 199 of a fluid pressure cylinder 201 to which the outer lever 187 is pinned at 203 so that upon the introduction of pressurized fluid into the respective cylinders 201, the adjacent ends of the pairs of levers 187 associated with the respective discs are spread apart causing the shoe-mounting ends of the respective levers to move toward each other and cause the shoes 195 to grip the discs. The end of central member 183 of the brake fulcrum plate nearest the axle is formed with an upstanding flange 205 connecting upstanding swing link bracket 186 and a spherical connection 207 secures a longitudinally extending link 209 to flange 205, the other end of link 209 being secured by a similar spherical connection 211 to a bracket 213 depending from truck frame 45 for the same purpose as link 149 in the previously described embodiment.

In the embodiment of the invention illustrated in FIGS. 10–14, the axle bearing adapters mount one-piece C-shaped frames or yokes comprising longitudinally extending side members 213 secured at their ends to adapters 7 and extending longitudinally therefrom toward the center of the truck, and connected by a transverse member 215 such that yokes 213, 215 follow the axle through its turning movements in the horizontal plane. Substantially at the intersections of the longitudinal and transverse portions 213 and 215 of the yokes, diagonal rods 217 and 219 are pivoted at 221 and 223 to the yokes and function as described previously with regard to the first and second embodiments of the invention.

In the present embodiment, a dual brake system includes tread brake arrangements 81–97 supported from brackets 84 on side frame abutments 31, substantially as described above and in connection with the embodiment of FIGS. 1–5, is provided and a disc brake arrangement comprising a single disc 101 mounted at the center of each of the axles 2 and 3, shoes 137 mounted on brake heads 133 directly beneath the respective axles 2 and 3 and pivotally connected at 135 to the ends of longitudinally extending levers 129 fulcrumed intermediate their ends at 225 to fulcrum plate 227 and pivotally connected at their opposite ends at 141 and 145 to fluid pressure cylinder 139 and piston 143, respectively.

In this arrangement, in the interest of simplicity, the entire brake mechanism is supported directly by fulcrum plate 227 from an elongated bracket 229 extending from the center of the main frame transom 47 toward each axle and sloping downward from its juncture with the frame to a level slightly below that of the axles, the fulcrum plate 227 being secured to the bottom of lower extremity of bracket 229. While this construction has the advantage of simplicity over the brake mechanism mountings of the previous embodiments in that the longitudinally acting braking torque reactions are taken from the shoes 137 through levers 129, fulcrum pins 225 and fulcrum plate 227 and bracket arm 229 into the truck transverse frame 45*a*, it has the disadvantage that the brake mechanism does not follow the axles during yawing and steering movements, particularly the latter, such that it would provide less freedom to self-induced steering movement of the respective axles than would the brake mechanism mountings of the previous embodiments.

The details of the truck structure and the associated brake arrangements may be varied substantially without departing from the spirit of the invention and the exclusive use of those modifications as come within the scope of the appended claims is contemplated.

I claim:

1. In a railway truck having a pair of longitudinally spaced wheel and axle assemblies each comprising an axle and a pair of wheels mounted thereon, bearing structures including journal bearings supported on the end portions of said wheel and axle assemblies at each side of the truck, a longitudinally extending side frame at each side of the truck supported at its ends on said bearing structures and having end portions extending above said bearing structures, a horizontal center portion depressed to a lower level than said journal bearings and defining at its ends opposing generally transverse abutments, a truck frame extending transversely of the truck and having longitudinally extending side members positioned within said side frame depressed portions with the end surfaces of said side members opposing said abutments, elastomeric chevron-shaped spring devices interposed between said abutments and said truck frame side member end surfaces, said journal bearing structures and said side frame end portions having opposing horizontal surfaces, horizontal elastomeric pad devices interposed between the opposing journal bearing structure and side frame surfaces and being yieldable in shear horizontally to accommodate turning movements of the respective axles in the horizontal plane with respect to said side frames to positions radial of the track on curves, brake disc structure centered on each said axle, brake shoes positioned directly below said axles for gripping engagement with said disc structures, brake operating mechanism comprising longitudinally extending levers operatively connected to said shoes at the same level thereof, a transversely extending structure supported on each axle, a common fulcrum support element for the levers associated with each axle being supported from the respective transversely extending structure and fixed against transverse and angular movement with respect to the respective axle, and a longitudinally extending link centered transversely of the truck and pivotally connected at one end to one of said fulcrum support elements and at its other end to said truck frame for taking longitudinally-acting braking torque reactions from said shoes into said truck frame whereby to oppose forward inertial movement of said truck frame relative to the axles during brake applications and thereby to maintain the normal longitudinal relationship of said axles and said side frames under braking conditions.

2. In a railway truck according to claim 1, means diagonally interconnecting the opposite ends of the respective axles to cause such turning movements to be equal in magnitude and opposite in sense.

3. In a railway truck according to claim 1, a pair of said horizontal pad devices positioned fore and aft respectively of each said journal bearing structure, at least one of each said pair being elongated transversely of the truck to oppose transverse tilting of the respective side frames.

4. In a railway truck according to claim 3, said horizontal pad devices nearest the ends of said side frames being elongated transversely of the truck and said horizontal pad devices remote from the ends of said side frames being elongated longitudinally of the truck.

5. In a railway truck according to claim 4, said horizontal pad devices nearest the end of said side frames projecting transversely from the respective side frames and said horizontal pad devices remote from the ends of said side frames being positioned entirely between the sides of the respective side frames.

6. In a railway truck according to claim 2, said diagonal interconnecting means being connected at their ends to said transversely extending structure, said transversely extending structure comprising a yoke having longitudinally extending side members secured to the respective journal bearing structures and extending longitudinally therefrom toward the center of the truck and said yoke also having a transverse member connecting said side members.

7. In a railway truck according to claim 6, said diagonal interconnecting means also including a pair of diagonal links each having its opposite end pivotally connected on a vertical axis to the respective yokes.

8. In a railway truck according to claim 7, said wheels having treads of sufficient conicity to steer said wheel and axle assemblies into substantially radial positions on curved track.

9. In a railway truck according to claim 1, said transversely extending structure comprising transverse yokes supported on said journal bearing structures of the respective axles, pairs of longitudinally and transversely spaced swing links swingable longitudinally of the truck and supporting each said fulcrum support element from the respective yoke and holding said fulcrum support elements substantially horizontal irrespective of braking torque reactions transmitted to said fulcrum support element by said levers, said longitudinally spaced swing links absorbing the vertical eccentric moment between the brake shoes and the longitudinally extending anchor link.

10. In a railway truck according to claim 9, each said fulcrum support element being at a lower level than the central portion of said truck frame and having an upstanding abutment, said longitudinally extending anchor link member being substantially horizontal and pivotally connected at said one end to said upstanding abutment.

11. In a railway truck according to claim 10, said truck frame having a depending abutment at the same level as said upstanding abutment on said fulcrum support element and in substantial longitudinal alignment therewith and providing the pivotal connection of said longitudinally extending anchor link member to said truck frame.

12. In a railway truck according to any one of claims 1 and 9–11, said disc structure on each axle consisting of a single disc at the center of the axle.

13. In a railway truck according to claim 12, a tread brake arrangement at each side of the truck comprising brake levers pivotally depending from said side frames longitudinally inwardly of and adjacent to the respective wheels, brake heads pivotally mounted on said levers, a cylinder and piston assembly connected at its opposite ends to the respective levers for selectively urging said brake shoes into frictional engagement with the respective wheels, fluid conduit means connecting the cylinders at the opposite sides of the truck to each other and means for selectively introducing pressurized fluid into said cylinders to move said brake shoes into frictional engagement with said wheels.

14. In a railway truck according to any one of claims 1 and 9–11, said disc structure on each axle consisting of a pair of discs spaced apart from each other transversely of the axle and spaced inwardly thereof from the wheels, there being a pair of said shoes embracing each disc and a pair of said levers operatively connected to each said pair of shoes, all of said levers being fulcrumed on said common fulcrum support element, said longitudinally extending link being connected to said fulcrum support element between the inner levers of each pair of levers and in closer proximity to the respective axle than the common radius of said discs.

15. In a railway truck according to claim 14, electromagnetic track brake means suspended from said truck frame at each side inboard of said side frames and in substantial alignment longitudinally of the truck with the respective wheels.

16. In a railway truck according to claim 15, said electromagnetic track brake means comprising an electromagnet elongated longitudinally of the truck and normally in vertically spaced relation with the track rails, a pair of vertically disposed operating cylinders positioned respectively forwardly and rearwardly of said truck frame transom and forwardly and rearwardly extending bracket means on said truck frame transom pivotally supporting said operating cylinders.

17. In a railway truck according to any one of claims 1, 10 and 11, each said longitudinally extending link having a spherical pivot connection respectively to the respective fulcrum support element and the truck frame whereby to accommodate relative vertical, swivel and tilting movements of the respective axles relative to said truck frame with minimal interference with any of such relative movements.

18. In a railway truck according to claim 1, a transverse bolster swivelly supported on said truck frame to permit said frame to pivot about a vertical axis at its center, upright spring devices carried at the ends of said bolster and adapted to support directly a vehicle underframe, said spring devices being yieldable horizontally and vertically to accommodate lateral as well as vertical cushioning movements of the supported underframe with respect to said bolster, and longitudinally extending anchor link means adapted to connect said bolster to the supported underframe to accommodate lateral and vertical movements of the supported underframe on said bolster while preventing substantial longitudinal movements therebetween and thereby transmitting traction and braking forces between said bolster and the supported underframe.

19. In a railway truck according to claim 1, said truck frame having depending bracket structure having surfaces spaced from and opposing the inner surfaces of the respective side frames and adapted for engagement therewith in the event excessive lateral forces tending to overturn the respective side frames are incurred whereby to limit the application of said forces to the respective side frames.

20. In a railway truck according to claim 7, said diagonal links being connected to the respective yokes transversely inwardly of the sides thereof, whereby the axial projections of said links intersect the respective axles at the centers of the journal portions thereof.

21. In a railway truck according to claim 7, the connections of said diagonal links to the respective yokes being in closely proximate relation with the transversely outermost portions thereof, whereby the axial projections of the respective links intersect the axial projections of the respective axles substantially outwardly of the journal portions of the respective axles.

22. In a railway truck having a wheeled axle, truck framing resiliently supported from said axle, said axle being steerable between a tangent-track position parallel to the transverse axis of the truck frame and a curved track position angulated with respect to the longitudinal axis of the truck frame, brake disc structure centered on said axle, brake shoes mounted directly below said axle for gripping engagement with said disc structure, brake operating mechanism comprising longitudinally extending levers operatively connected to said shoes at substantially the same level as said shoes, a transversely extending structure supported on said axle, a common fulcrum support element for said levers supported from said transversely extending structure and fixed against transverse and angular movements with respect to said axle, and a single longitudinally extending link centered transversely of the truck and pivotally connected at its respective ends to said fulcrum support element and to said truck frame for taking longitudinally acting braking torque reaction from said shoes into said truck frame whereby to oppose inertial longitudinal movement of said truck frame relative to the axle during brake applications and thereby to maintain substantially the normal longitudinal relationship of said axle and said truck framing under braking conditions.

23. In a railway truck according to claim 22, said transversely extending structure comprising a transversely extending yoke supported from said axle longitudinally inboard thereof, pairs of longitudinally and transversely spaced swing links swingable longitudinally of the truck and supporting said fulcrum support element from said yoke and holding said fulcrum support element substantially horizontal irrespective of braking torque reactions transmitted to said fulcrum support element by said levers.

24. In a railway truck according to claim 23, each said fulcrum support element being at a lower level than the central portion of said truck frame and having an upstanding abutment providing the pivotal connection of said longitudinally extending link to said fulcrum support element.

25. In a railway truck according to claim 24, said framing having a depending abutment substantially in longitudinal alignment with the upstanding abutment on said fulcrum support element and providing a pivotal connection of said longitudinally extending link to said truck frame.

26. In a railway truck according to any one of claims 22 and 23–25, said disc structure consisting of a single disc at the center of the axle.

27. In a railway truck according to any one of claims 22 and 23–25, said disc structure consisting of a pair of discs spaced apart from each other transversely of the axle and spaced inwardly thereof from the wheels, there being a pair of said shoes embracing each disc and a pair of said levers operatively connected to each said pair of shoes, all of said levers being fulcrumed on said common fulcrum support element, said anchor link being connected to said fulcrum support element between the inner levers of each pair of levers and in closer proximity to the axle than the common radius of said discs.

28. In a railway truck according to any one of claims 22 and 23–25, said longitudinally extending link having spherical pivot connections respectively to the fulcrum support element and to the truck frame, whereby to accommodate relative vertical, swivel and tilting movements of the said axle relative to said truck frame with minimal interference with any of such relative movements.

29. In a railway truck having a pair of longitudinally spaced wheel and axle assemblies each comprising an axle and a pair of wheels mounted thereon, bearing structures including journal bearings supported on the end portions of said wheel and axle assemblies at each side of the truck, a longitudinally extending side frame at each side of the truck supported at its ends on said bearing structures and having end portions extending above said bearing structures, a transverse member resiliently supported on and connecting said side frames, said journal bearing structure having fore and aft surfaces, each said side frame having opposing horizontal surfaces equally spaced vertically from the respective journal bearing horizontal surfaces, said horizontal elastomeric pad devices interposed between the opposed journal bearing structure and side frame surfaces, at least one of said horizontal pad devices associated with each journal bearing structure being elongated in plan with their long dimensions extending transversely of the truck to oppose transverse tilting of the respective side frames, said horizontal pad devices nearest the ends of said side frames being elongated in plan with their long dimensions extending transversely of the truck and said horizontal pad devices remote from the ends of said side frames being elongated in plan with their long dimensions extending longitudinally of the truck.

30. In a railway truck according to claim 29, said first-named pad devices projecting transversely from the respective side frames and said last-named pad devices being positioned entirely between the sides of the respective side frames.

* * * * *